US008051788B2

(12) United States Patent
Chang

(10) Patent No.: US 8,051,788 B2
(45) Date of Patent: Nov. 8, 2011

(54) DRIVING DEVICE FOR THREAD HOOKING MECHANISM FOR SEWING MACHINE

(75) Inventor: Hsien-Chin Chang, Sanchong (TW)

(73) Assignee: Sewtech Corporation, Taoyuan County (TW)

( * ) Notice: Subject to any disclaimer, the term of this patent is extended or adjusted under 35 U.S.C. 154(b) by 307 days.

(21) Appl. No.: 12/487,700

(22) Filed: Jun. 19, 2009

(65) Prior Publication Data

US 2010/0319598 A1 Dec. 23, 2010

(51) Int. Cl.
*D05B 69/00* (2006.01)

(52) U.S. Cl. ..... 112/220

(58) Field of Classification Search ..... 112/225, 112/228, 224, 259, 201, 202, 191, 193, 220
See application file for complete search history.

(56) References Cited

U.S. PATENT DOCUMENTS 2,095,450 A * 10/1937 Myers ..... 112/184
2,609,770 A * 9/1952 Christensen ..... 112/202
3,910,161 A * 10/1975 Beckwell ..... 91/375 R
7,565,873 B2 * 7/2009 Yamasaki ..... 112/184

* cited by examiner

*Primary Examiner* — Tejash Patel
(74) *Attorney, Agent, or Firm* — Alan Kamrath; Kamrath & Associates PA

(57) ABSTRACT

A sewing machine includes upper and lower beams. A thread hooking mechanism is mounted in the lower beam. A needle plate base is mounted to an end of the lower beam. A transmission shaft rotatably extends in the lower beam and has an end extending into the needle plate base. The transmission shaft can be driven by a power source. A driving device is mounted to the end of the lower beam and includes a transmission gear fixed on the end of the transmission shaft, a driven shaft rotatably received in the needle plate base and having an end coupled to the thread hooking mechanism, and a driven gear fixed on the driven shaft and connected to the transmission gear, with the driven shaft and the thread hooking mechanism rotating at a speed higher than the transmission shaft.

4 Claims, 10 Drawing Sheets

DRIVING DEVICE FOR THREAD HOOKING MECHANISM FOR SEWING MACHINE

BACKGROUND OF THE INVENTION

The present invention relates to a driving device for a thread hooking mechanism for a sewing machine and, more particularly, to a driving device for a threading hooking mechanism for a sewing machine requiring a larger sewing space for a workpiece with a large thickness.

FIGS. 1-4 show a sewing machine suitable for stitching a fluffy, multilayer workpiece such as cloth or leather. The sewing machine includes a body 10 having upper and lower beams 11 and 12. A head 13 is mounted to an end of the upper beam 11. A needle plate base 20 is mounted to an end of the lower beam 12 and aligned with the head 13. A transmission shaft 15 extends in the upper beam 11 and can be driven by a power source 14 in the form of a motor via a pulley 14 and a belt 142. A transmission shaft 16 extends in the lower beam 12 and is connected to an end of the transmission shaft 15 by pulleys 151 and 161 and a timing belt 152. A stitching device 17 is coupled to the other end of the transmission shaft 15 and includes a needle 171 and a pressing device 18 having a pressing leg 181. When the motor 14 is activated, the needle 171 and the pressing legs 181 move reciprocatingly in a vertical direction. When sewing a workpiece having a larger thickness in the vertical direction, a thread hooking mechanism 19 is driven by the transmission shaft 16 via a driving device 50, so as to hook a thread on the stitch 171 and a bottom thread on a shuttle core 193 of a shuttle 192 in the thread hooking mechanism 19 for the purposes of sewing operation.

Specifically, a transmission wheel 51 is mounted on an end of the transmission shaft 16 and connected via a timing belt 54 to a driven wheel 53 mounted on a driven shaft 52 that is driven by the timing belt 54. The other end of the transmission shaft 16 extends into the needle plate base 20. The thread hooking mechanism 19 rotates at a speed two times of that of the transmission shaft 16. Furthermore, two tension wheels 55 and adjusting wheel seats 56 as well as adjusting bolts 57 and 58 are provided to adjust the tension of the timing belt 54.

The spacing between the head 13 and the needle plate base 20 is fixed, and the spacing between the transmission shaft 16 and the driven shaft 52 in the vertical direction provides a larger space between a bottom face of the upper beam 11 and a top face of the lower beam 12 for the purposes of easy sewing operation. However, the conventional driving device 50 has quite a few members and requires troublesome manufacturing, processing, assembling, and adjustment, leading to a waste in labor and time while increasing the costs. Furthermore, the timing belt 54 is liable to wear out and not easy to be detached for maintenance.

Thus, a need exists for a novel driving device for a threading hooking mechanism for a sewing machine that is simple in structure, more durable, easy to manufacture, easy to process, and easy to assemble, so that the manufacturing costs can be reduced and that the functionality can be enhanced.

BRIEF SUMMARY OF THE INVENTION

The present invention solves this need and other problems in the field of sewing machines for workpieces of larger thicknesses by providing, in a preferred form, a sewing machine including an upper beam and a lower beam below and spaced from the upper beam in a vertical direction. A head is mounted on an end of the upper beam and includes a stitching device and a pressing device. A thread hooking mechanism is mounted in the lower beam. A needle plate base is mounted to an end of the lower beam and located below the head and spaced from the head in the vertical direction. A transmission shaft rotatably extends in the lower beam and has an end extending into the needle plate base. The transmission shaft is adapted to be driven by a power source. A driving device is mounted to the end of the lower beam and includes a transmission gear fixed on the end of the transmission shaft, a driven shaft rotatably received in the needle plate base and having an end coupled to the thread hooking mechanism, and a driven gear fixed on the driven shaft and connected to the transmission gear, with the driven shaft and the thread hooking mechanism rotating at a speed higher than the transmission shaft.

In a preferred form, the needle plate base includes a top plate and a side plate. The side plate includes a plurality of through-holes. The end of the lower beam includes a plurality of screw holes aligned with the through-holes. A plurality of bolts extends through the through-holes into the screw holes. The side plate further includes through which the end of the transmission shaft extends. The end of the lower beam includes a first bearing seat receiving a first bearing. The end of the transmission shaft extends through the first bearing. The driven shaft is located above the transmission shaft. A spacing is formed between the driven shaft and the transmission shaft in the vertical direction. The transmission gear has a tooth number larger than that of the driven gear. The top plate includes an opening above the thread hooking mechanism. A needle plate is fixed in the opening. The needle plate base further includes a second bearing seat formed on a bottom face of the top plate and receiving a second bearing. An end of the driven shaft rotatably extends through the second bearing. The side plate further includes a bearing receiving hole receiving a third bearing through which the other end of the driven shaft extends.

In another preferred form, at least one intermediate shaft is intermediate the transmission shaft and the driven shaft. The at least one intermediate shaft includes at least one intermediate gear intermediate and meshed with the transmission gear and the driven gear.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
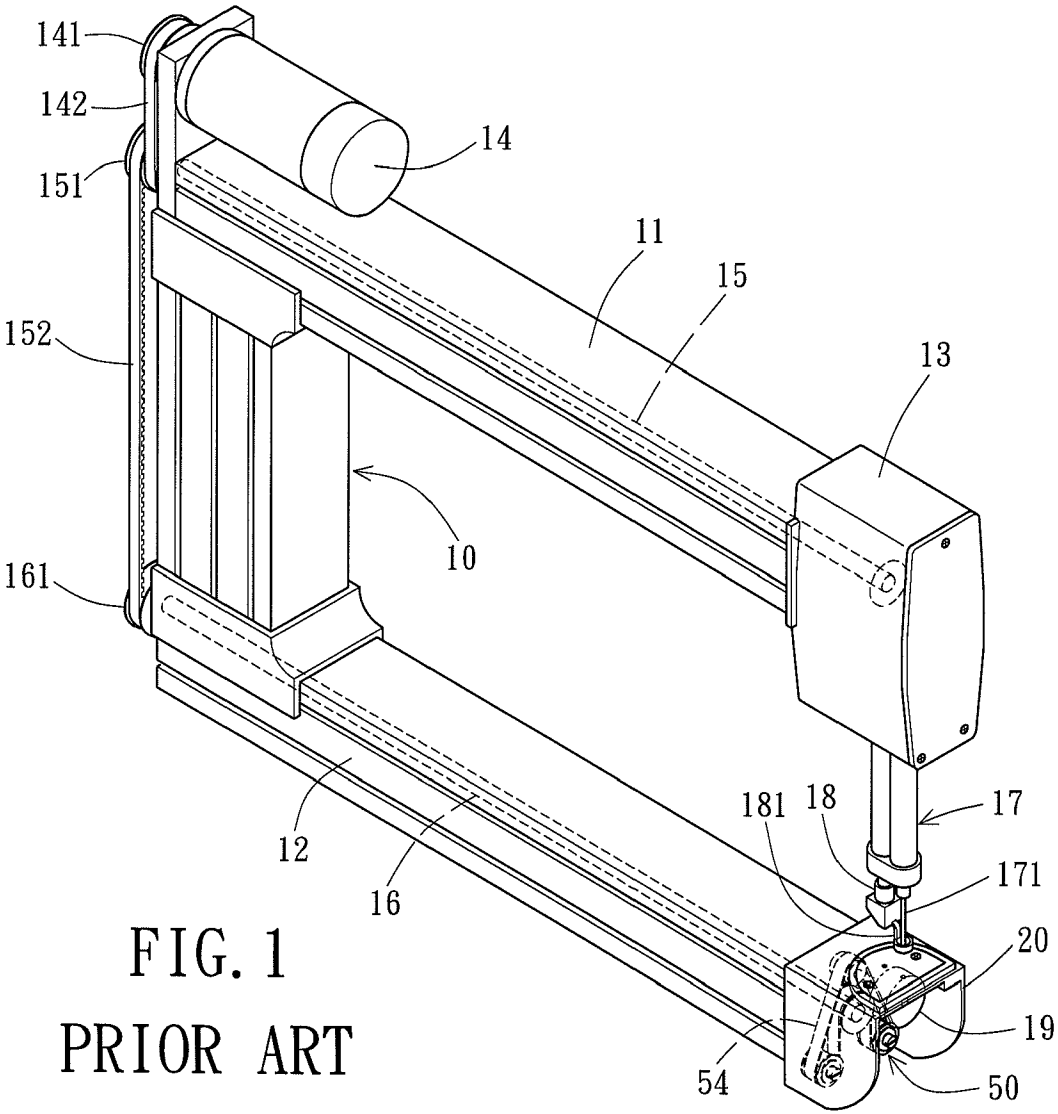
FIG. 1 PRIOR ART
FIG. 1 shows a perspective view of a conventional sewing machine.
Figure 2:
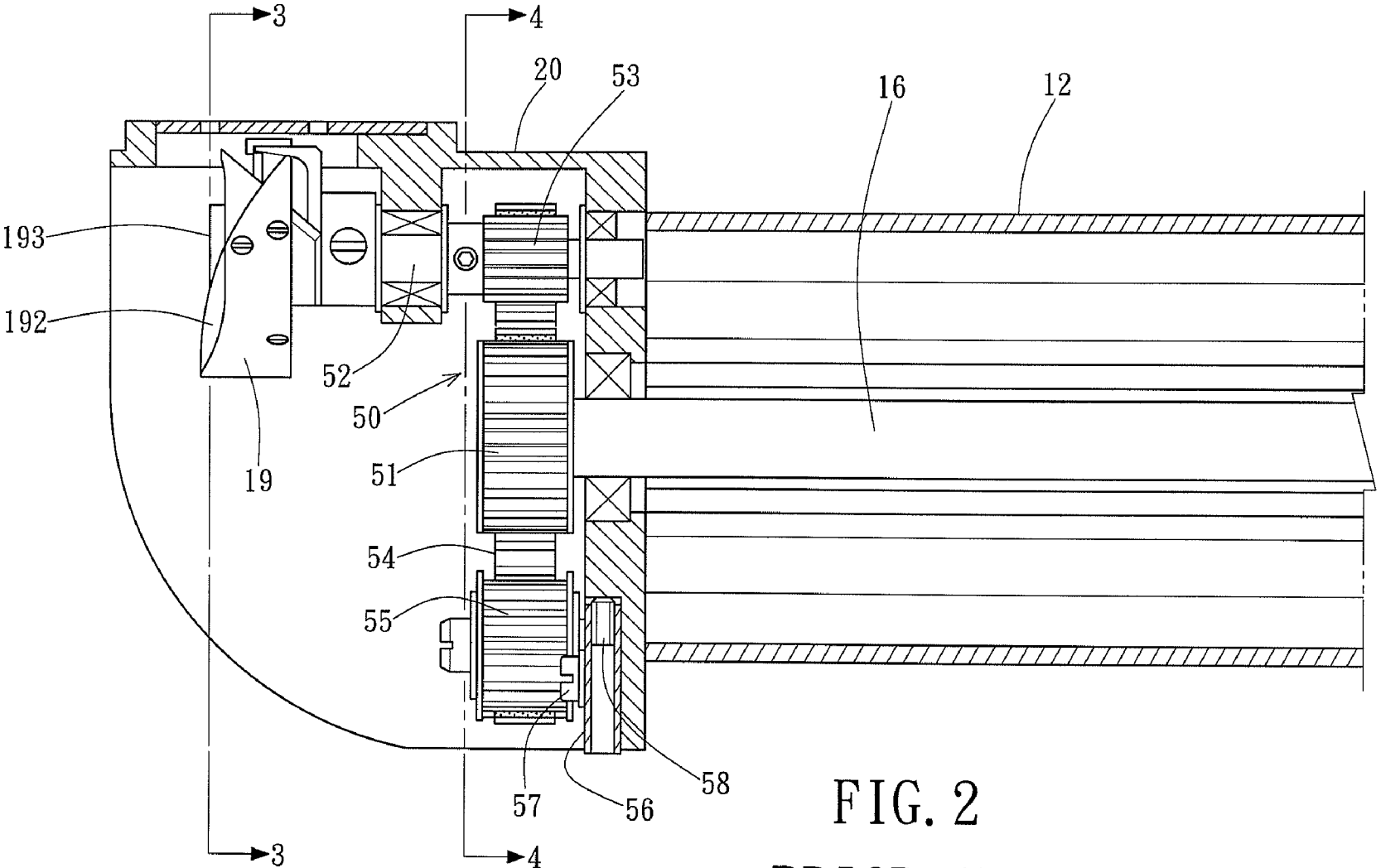
FIG. 2 PRIOR ART
FIG. 2 shows a partial, cross sectional view of the sewing machine of FIG. 1.
Figure 3:
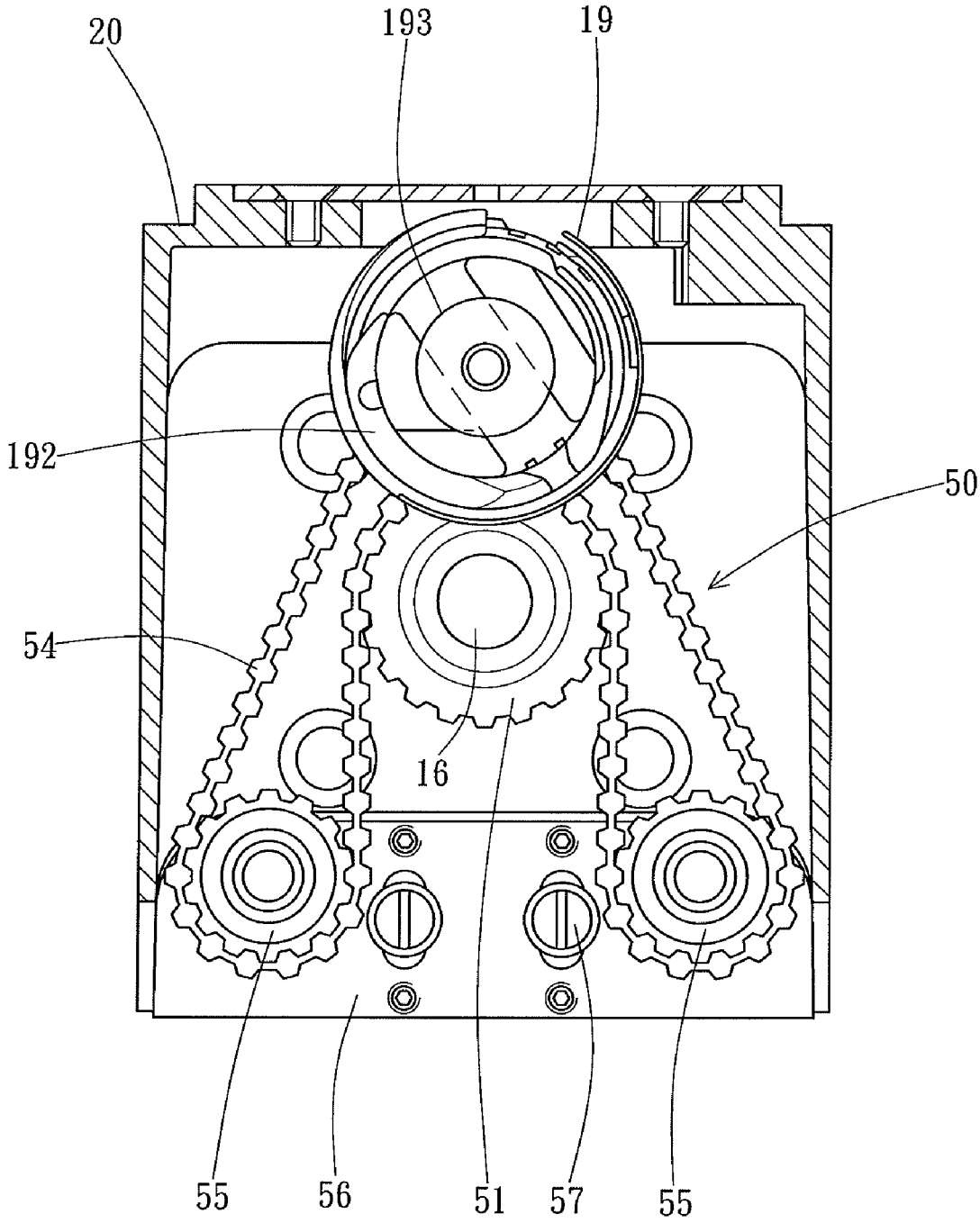
FIG. 3 PRIOR ART
FIG. 3 shows a cross sectional view of the sewing machine of FIG. 1 according to section line 3-3 of FIG. 2.
Figure 4:
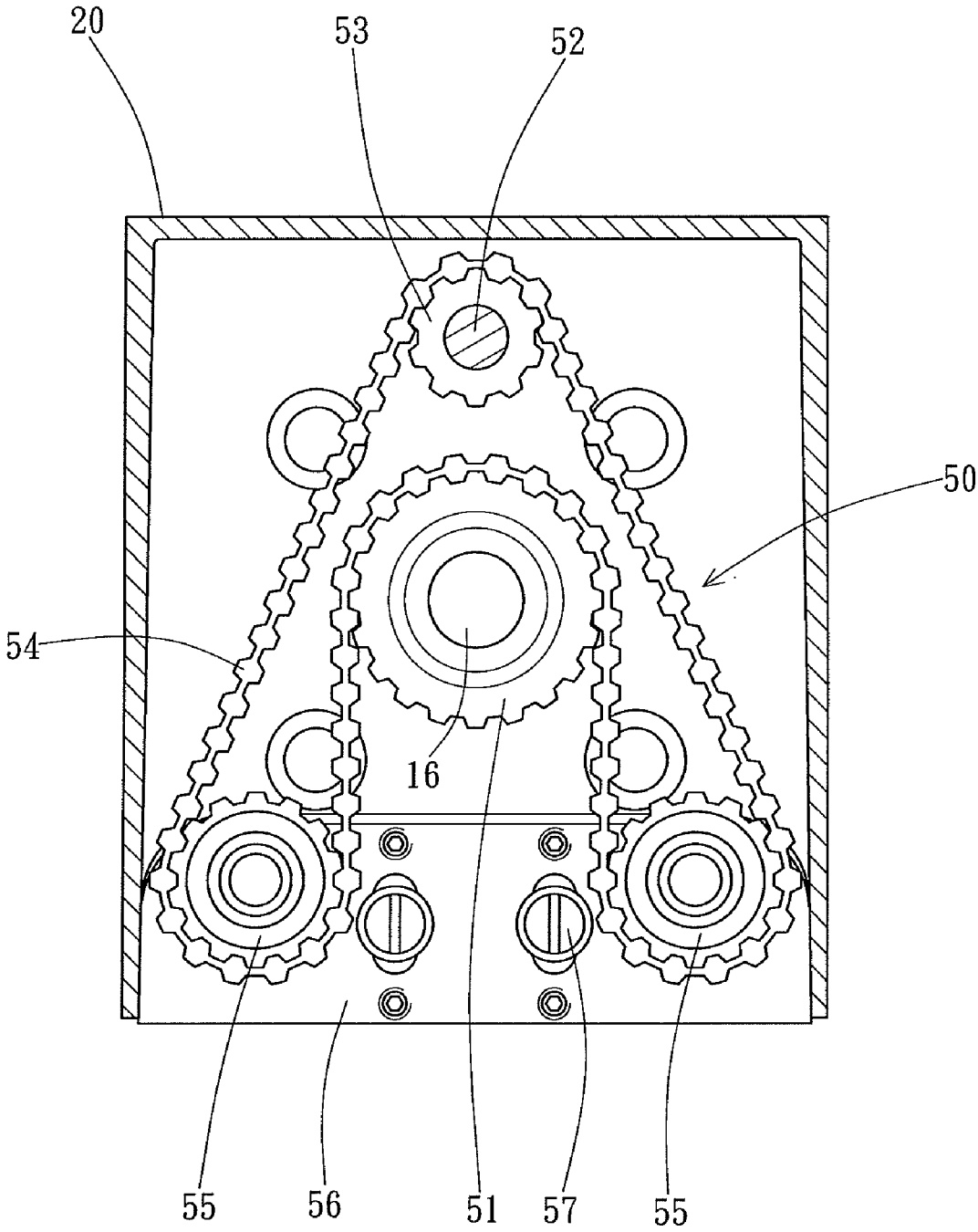
FIG. 4 PRIOR ART
FIG. 4 shows a cross sectional view of the sewing machine of FIG. 1 according to section line 4-4 of FIG. 2.
Figure 5:
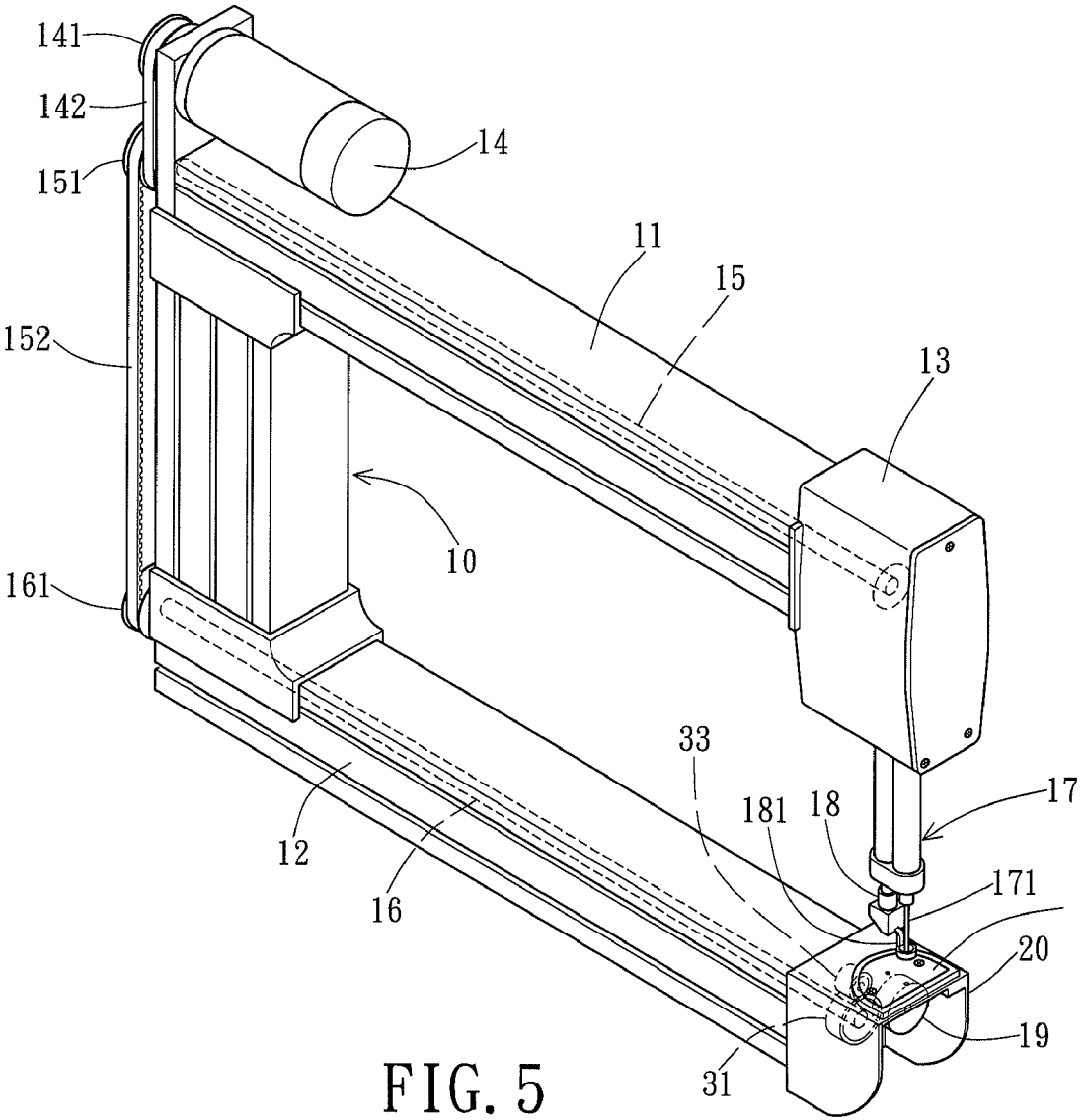
FIG. 5 shows a perspective view of a sewing machine according to the preferred teachings of the present invention.
Figure 6:
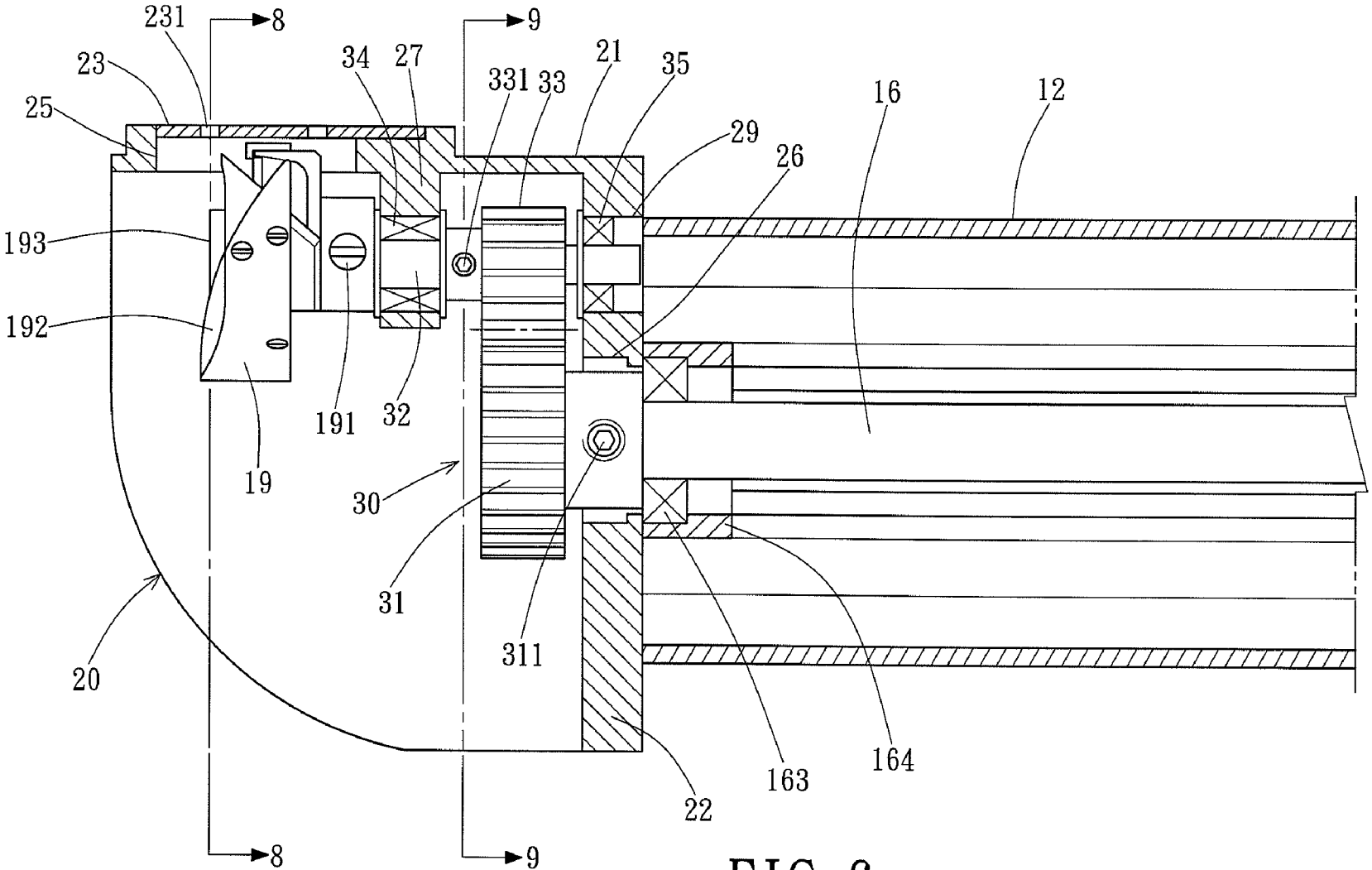
FIG. 6 shows a partial, cross sectional view of the sewing machine of FIG. 5.
Figure 7:
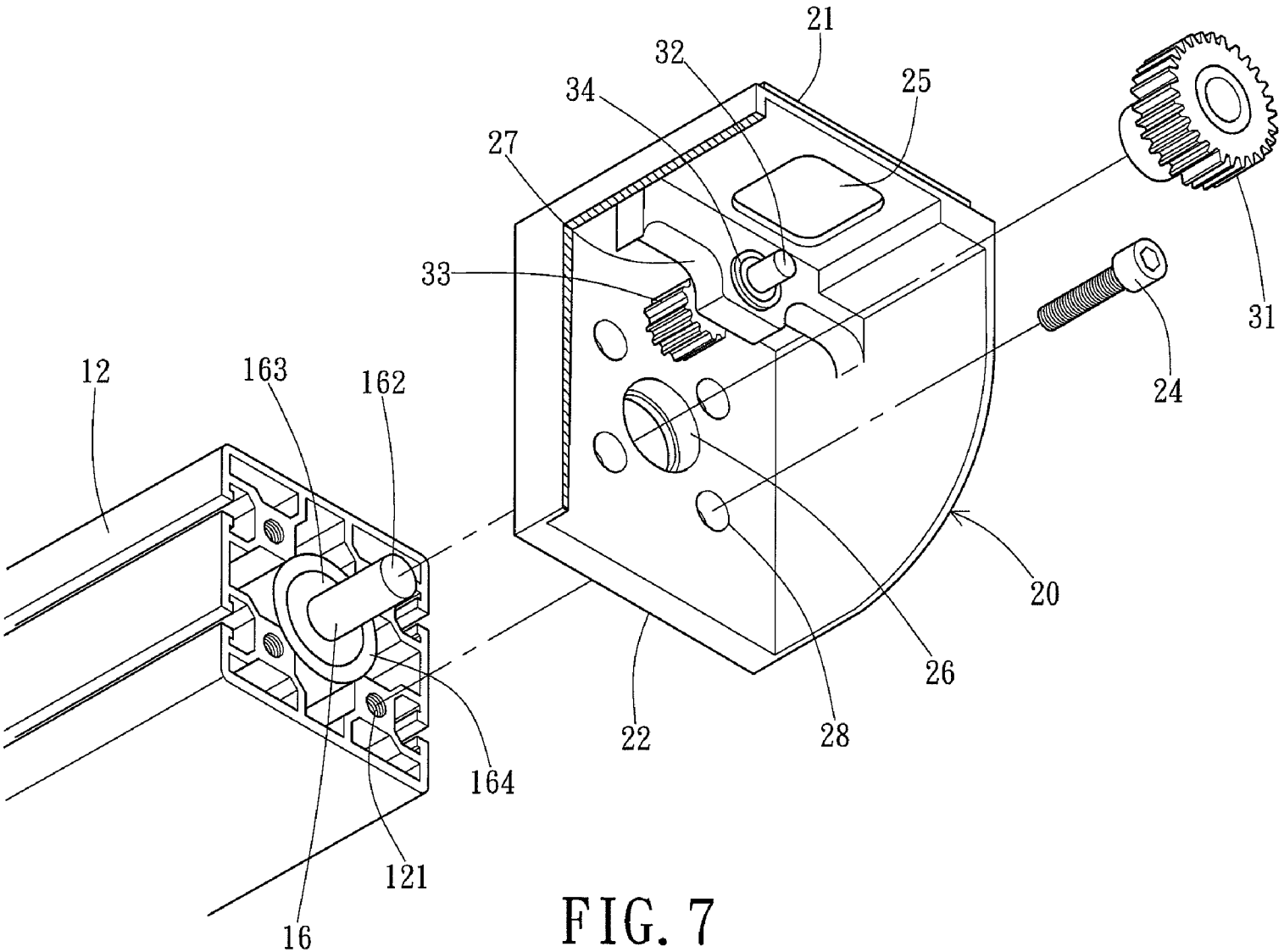
FIG. 7 shows a partial, exploded, perspective view showing a driving device of the sewing machine of FIG. 5.
Figure 8:
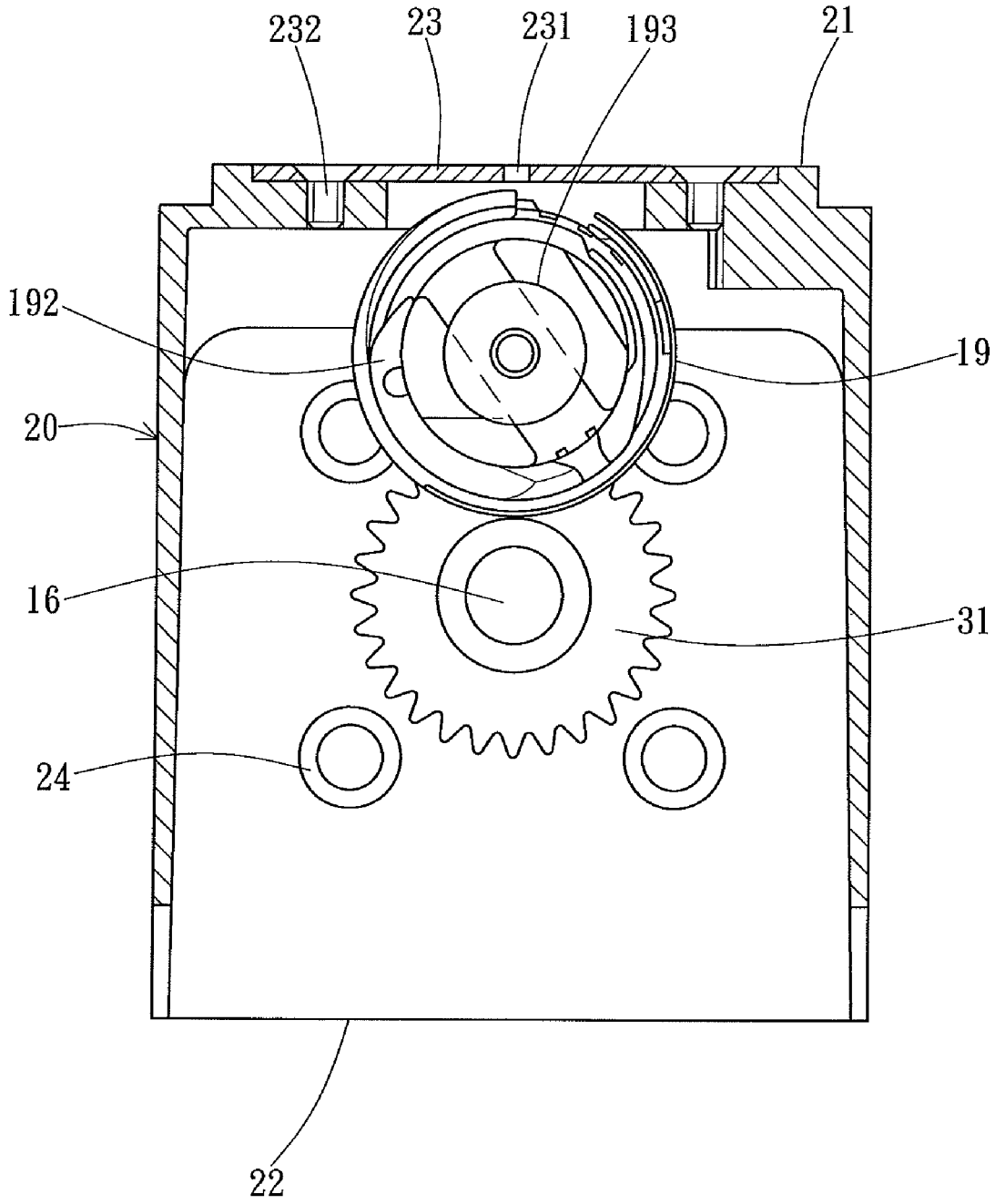
FIG. 8 shows a cross sectional view of the sewing machine of FIG. 5 according to section line 8-8 of FIG. 6.
Figure 9:
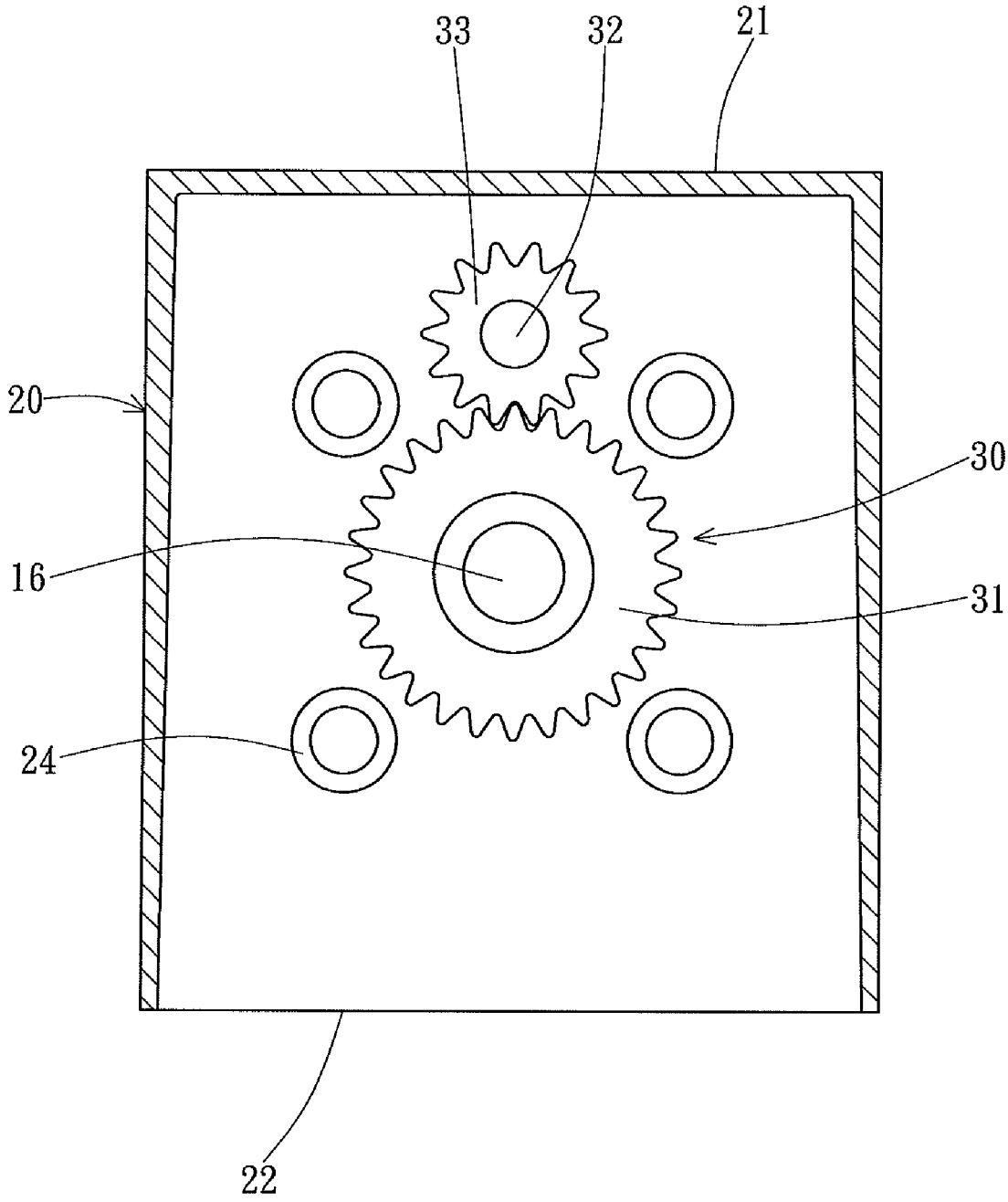
FIG. 9 shows a cross sectional view of the sewing machine of FIG. 5 according to section line 9-9 of FIG. 6.
Figure 10:
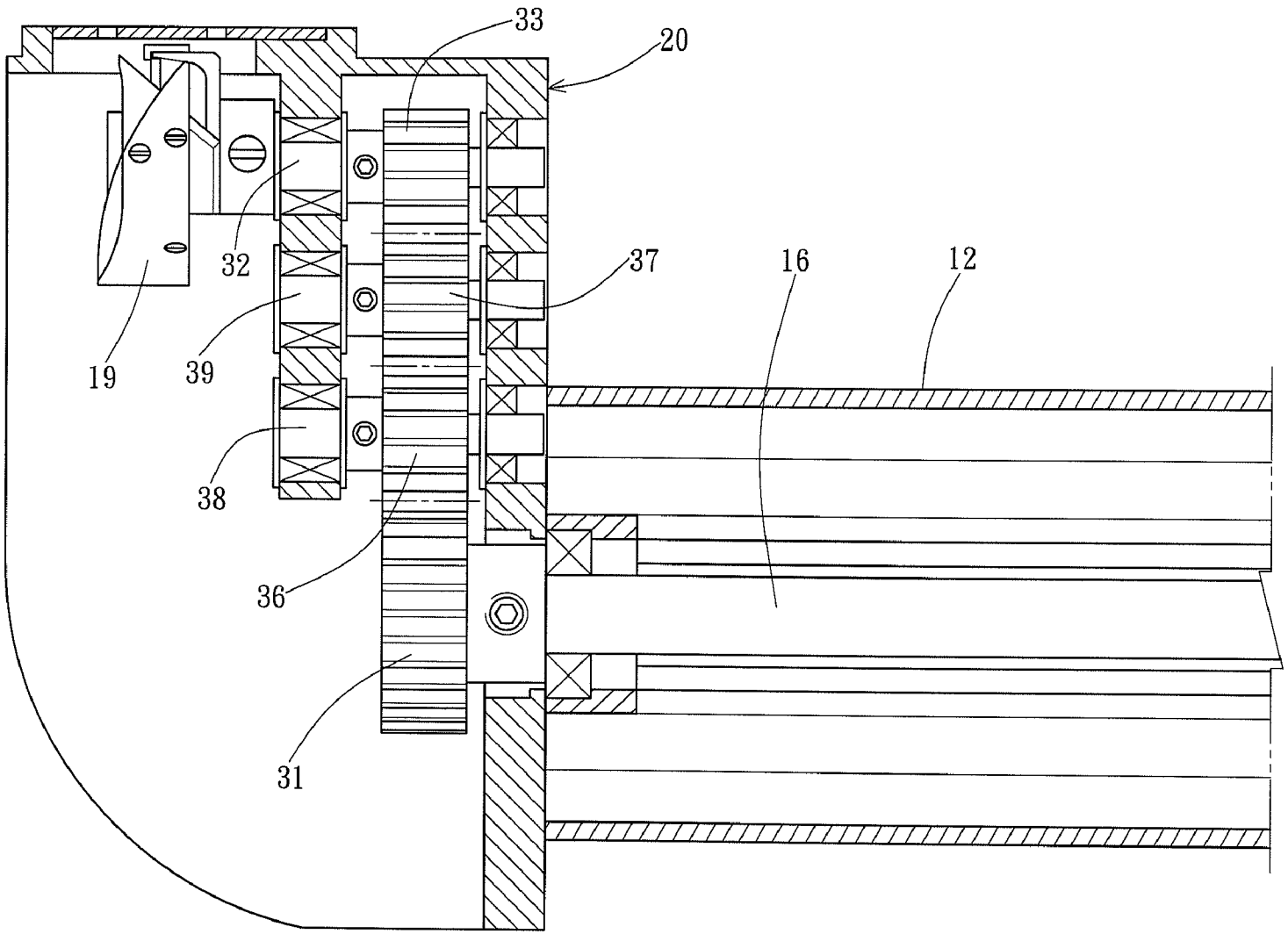
FIG. 10 shows a partial, cross sectional view of a sewing machine of a modified embodiment according to the preferred teachings of the present invention.

A driving device 30 for a thread hooking mechanism 19 of a sewing machine according to the preferred teachings of the present invention is shown in FIGS. 5-10. The sewing machine includes a body 10 having upper and lower beams 11 and 12. A head 13 is mounted to an end of the upper beam 11. A needle plate base 20 is mounted to an end of the lower beam 12 and aligned with the head 13 and spaced from the head 13 in a vertical direction. A transmission shaft 15 extends in the upper beam 11 and can be driven by a power source 14 in the form shown as a motor via a pulley 14 and a belt 142. A transmission shaft 16 extends in the lower beam 12 and is connected to an end of the transmission shaft 15 by pulleys 151 and 161 and a timing belt 152. A stitching device 17 is coupled to the other end of the transmission shaft 15 and includes a needle 171 and a pressing device 18 having a pressing leg 181. The driving device 30 is mounted to the end of the lower beam 12 and in the needle plate base 20. The driving device 30 can be driven by the transmission shaft 16 to drive the thread hooking device 19 to rotate at a higher speed. A fixed spacing is formed between the head 13 and the needle plate base 20 in the vertical direction. When the motor 14 is activated, the needle 171 and the pressing legs 181 move reciprocatingly in the vertical direction.

In the preferred forms shown in FIGS. 5-10, an end 162 of the transmission shaft 16 extends through the lower beam 12 into the needle plate base 20. A transmission gear 31 is fixed by a screw 311 on the end 162 of the transmission shaft 16. A driven shaft 32 is rotatably received in the needle plate base 20 and includes an end coupled to the thread hooking mechanism 19. A driven gear 33 is fixed by a screw 331 on the driven shaft 32 and connected to the transmission gear 31. The rotating speed of the driven shaft 32 and the thread hooking mechanism 19 is higher than and preferably two times of that of the transmission shaft 16, so that the thread hooking mechanism 19 can reliably hook a thread on the stitch 171 and a bottom thread on a shuttle core 192 of a shuttle 192 in the thread hooking mechanism 19 for the purposes of sewing operation. In the preferred form shown in FIGS. 5-9, the transmission gear 31 directly meshes with the driven gear 33. In the preferred form shown in FIG. 10, two intermediate shafts 38 and 39 are provided between the transmission shaft 16 and the driven shaft 32. Intermediate gears 36 and 37 are provided on the intermediate shafts 38 and 39, so that the transmission gear 31, the intermediate gears 36 and 37, and the driven gear 33 mesh with one another in sequence. The spacing between the transmission shaft 16 and the driven shaft 32 in the vertical direction is, thus, increased without changing the spacing between the head 13 and the needle plate base 20. The space between the bottom face of the upper beam 11 and the top face of the lower beam 12 for stitching operation is, thus, increased. It can be appreciated that the number of the intermediate shafts 38, 39 and the intermediate gears 36, 37 on the intermediate shafts 38, 39 can be varied according to need.

In the preferred forms shown in FIGS. 5-10, the needle plate base 20 includes a top plate 21 and a side plate 22. The side plate 22 has a plurality of through-holes 28 aligned with a plurality of screw holes 121 in the end of the lower beam 12. Bolts 24 are extended through the through-holes 28 of the side plate 22 into the screw holes 121 of the lower beam 12, allowing slight adjustment in the positions of the centers of the needle plate base 20, the driven shaft 32, and the driven gear 33 in the vertical direction, so that the driven gear 33 can reliably mesh with the transmission gear 31. The side plate 22 further includes a hole 26. The end 162 of the transmission shaft 16 extends through the hole 26 of the side plate 22. The transmission gear 31 is fixed by the screw 311 on the end 162 of the transmission shaft 16, as mentioned above. The end of the lower beam 12 includes a bearing seat 164 receiving a bearing 163 through which the transmission shaft 16 extends. The top plate 21 includes an opening 25 above the thread hooking mechanism 19. A needle plate 23 is fixed by bolts 232 in the opening 25 and has a needle hole 231 allowing passage of a needle. The needle plate base 20 further includes a bearing seat 27 formed on a bottom face of the top plate 21 and receives a bearing 34. The end of the driven shaft 32 is rotatably extended through the bearing 34. The thread hooking mechanism 19 is fixed by a screw 191 to the end of the driven shaft 32. The side plate 22 further includes a bearing receiving hole 29 receiving a bearing 35 through which the other end of the driven shaft 32 extends. The driven shaft 32 is located above the transmission shaft 16 with a fixed spacing formed therebetween. The number of teeth of the transmission gear 31 is twice as that of the teeth of the driven gear 33.

The driving device 30 for the threading hooking mechanism 19 for the sewing machine according to the teachings of the present invention is simple in structure, more durable, easy to manufacture, easy to process, and easy to assemble, so that the manufacturing costs can be reduced and that the functionality can be enhanced.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A sewing machine comprising:

an upper beam and a lower beam below and spaced from the upper beam in a vertical direction;

a head mounted on an end of the upper beam and including a stitching device and a pressing device;

a thread hooking mechanism mounted in the lower beam;

a needle plate base mounted to an end of the lower beam and located below the head and spaced from the head in the vertical direction;

a transmission shaft rotatably extending in the lower beam and having an end extending into the needle plate base, with the transmission shaft adapted to be driven by a power source; and a driving device mounted to the end of the lower beam and including a transmission gear fixed on the end of the transmission shaft, a driven shaft rotatably received in the needle plate base and having an end coupled to the thread hooking mechanism, and a driven gear fixed on the driven shaft and connected to the transmission gear, with the driven shaft and the thread hooking mechanism rotating at a speed higher than the transmission shaft, with the needle plate base including a top plate and a side plate, with the side plate including a plurality of through-holes, with the end of the lower beam including a plurality of screw holes aligned with the plurality of through-holes, with a plurality of bolts extending through the plurality of through-holes into the plurality of screw holes, with the side plate further including a hole, with the end of the transmission shaft extending through the hole, with the end of the lower beam including a first bearing seat receiving a first bearing, and with the end of the transmission shaft extending through the first bearing.

2. The sewing machine as claimed in claim 1, with the driven shaft located above the transmission shaft, with a spacing formed between the driven shaft and the transmission shaft in the vertical direction, and with the transmission gear having a tooth number larger than that of the driven gear.

3. The sewing machine as claimed in claim 1, with the top plate including an opening above the thread hooking mechanism, with a needle plate fixed in the opening, with the needle plate base further including a second bearing seat formed on a bottom face of the top plate and receiving a second bearing, with an end of the driven shaft rotatably extending through the second bearing, with the side plate further including a bearing receiving hole receiving a third bearing through which another end of the driven shaft extends.

4. The sewing machine as claimed in claim 1, further comprising: at least one intermediate shaft intermediate the transmission shaft and the driven shaft, with said at least one intermediate shaft including at least one intermediate gear intermediate and meshed with the transmission gear and the driven gear.

* * * * *